US008791953B2

(12) United States Patent
Kwon et al.

(10) Patent No.: US 8,791,953 B2
(45) Date of Patent: Jul. 29, 2014

(54) VALUE ADJUSTMENT METHODS, VALUE ADJUSTMENT SIGNAL PROCESSING APPARATUS, AND IMAGE DISPLAY SYSTEMS USING THE SAME

(75) Inventors: Hyung-dal Kwon, Suwon-si (KR); Dong-yul Lee, Gyeonggi-do (KR); See-wook Park, Suwon-si (KR); Yoon-kyung Choi, Yongin-si (KR); Hwa-hyun Cho, Seoul (KR)

(73) Assignee: Samsung Electronics Co., Ltd. (KR)

( * ) Notice: Subject to any disclaimer, the term of this patent is extended or adjusted under 35 U.S.C. 154(b) by 476 days.

(21) Appl. No.: 13/114,241

(22) Filed: May 24, 2011

(65) Prior Publication Data

US 2011/0292071 A1 Dec. 1, 2011

(30) Foreign Application Priority Data

May 25, 2010 (KR) ..... 10-2010-0048617

(51) Int. Cl.
*G09G 5/02* (2006.01)

(52) U.S. Cl.
USPC ..... 345/600; 345/589; 345/590; 345/601; 345/602; 345/604; 382/162; 382/167

(58) Field of Classification Search
None
See application file for complete search history.

(56) References Cited

U.S. PATENT DOCUMENTS

2009/0290068 A1* 11/2009 Abe et al. ..... 348/649

FOREIGN PATENT DOCUMENTS

| | | |
|---|---|---|
| JP | 2007-108249 | 4/2007 |
| JP | 2007-163761 | 6/2007 |
| KR | 1020060134369 A | 12/2006 |

* cited by examiner

*Primary Examiner* — Antonio A Caschera
(74) *Attorney, Agent, or Firm* — Myers Bigel Sibley & Sajovec, PA

(57) ABSTRACT

A method of adjusting value includes calculating a value of saturation from an input image signal, and adjusting a value of value of the input image signal according to a calculated saturation value. In the method, the value of value of the input image signal is adjusted by using a value adjustment algorithm for determining a value adjustment rate that decreases the value according to the saturation value.

20 Claims, 10 Drawing Sheets

VALUE ADJUSTMENT METHODS, VALUE ADJUSTMENT SIGNAL PROCESSING APPARATUS, AND IMAGE DISPLAY SYSTEMS USING THE SAME

CROSS-REFERENCE TO RELATED APPLICATIONS

This application claims the benefit of Korean Patent Application No. 10-2010-0048617, filed on May 25, 2010, in the Korean Intellectual Property Office, the disclosure of which is incorporated herein in its entirety by reference.

BACKGROUND

In general, display panels using a self-illumination element such as an organic light emitting diode (OLED) or a non-self-illumination element such as a liquid crystal display (LCD) are used not only for television sets but also for mobile devices such as mobile phones or portable multimedia players (PMPs). Thus, research has been conducted into ways of reducing power consumption and simultaneously minimizing distortion of an image in a display panel.

SUMMARY

The inventive concept provides value adjustment methods for adjusting a value according to saturation in order to reduce power consumption in an image display device.

The inventive concept provides a value adjustment signal processing apparatus for adjusting value according to saturation in order to reduce power consumption in an image display device.

The inventive concept provides image display systems using the value adjustment signal processing apparatus that adjusts a value according to saturation.

The inventive concept provides a recording medium having recorded thereon program codes to execute the value adjustment method that adjusts a value according to saturation in order to reduce power consumption in an image display device.

According to an aspect of the inventive concept, there is provided a method of adjusting value which includes calculating a value of saturation from an input image signal, and adjusting a value of value of the input image signal according to a calculated saturation value. In the method, the value of value of the input image signal is adjusted by using a value adjustment algorithm for determining a value adjustment rate that decreases the value according to the saturation value.

The value adjustment algorithm may determine the value adjustment rate to allow a rate of decrease of value to increase as the saturation value decreases.

According to another aspect of the inventive concept, there is provided an apparatus for processing a value adjustment signal, which includes a first color space converter for converting an image signal represented by an RGB color space into an image signal represented by a first color space including at least a saturation coordinate and a value-related coordinate, a value adjustment calculation unit for calculating a value adjustment rate corresponding to a saturation coordinate value of the image signal represented by the first color space by using a value adjustment algorithm for determining the value adjustment rate according to a saturation value, a value adjustment unit for adjusting a value-related coordinate value of the image signal represented by the first color space by using a calculated value adjustment rate, and a second color space converter for converting an image signal represented by the first color space in which the value-related coordinate value is adjusted into an image signal represented by the RGB color space.

The value adjustment algorithm may determine the value adjustment rate to allow a rate of decrease of value to linearly or non-linearly increase as the saturation value decreases.

The value adjustment algorithm may determine the value adjustment rate to allow a rate of decrease of value to linearly or non-linearly increase as the saturation value decreases without a decrease of the value on a condition that the saturation value reaches a maximum.

In the adjusting of a value of value of the input image signal, the value adjustment rate corresponding to the calculated saturation value may be obtained from a lookup table in which the value adjustment rate according to the saturation value is set, and the value of value of the input image signal is adjusted by using an obtained value adjustment rate.

In the adjusting of a value of value of the input image signal, the value adjustment rate corresponding to the calculated saturation value may be obtained from an operation formula based on the value adjustment algorithm for determining the value adjustment rate according to the saturation value, and the value of value of the input image signal is adjusted by using an obtained value adjustment rate.

The calculating of a value of saturation may include converting an input image signal represented by an RGB color space into an image signal represented by a color space comprising at least a saturation coordinate and a value-related coordinate, and determining a saturation coordinate value of an image signal represented by a converted color space as a saturation value of the input image signal.

The color space including at least a saturation coordinate and a value-related coordinate may include a hue, saturation, and value (HSV) color space, a hue, saturation, and lightness (HSL) color space, or a hue, saturation, and intensity (HSI) color space.

The adjusting of a value of value of the input image signal may include calculating the value adjustment rate corresponding to the calculated saturation value by using the value adjustment algorithm, and decreasing a value of a value-related coordinate in the input image signal represented by a color space comprising at least a saturation coordinate and the value-related coordinate by using the calculated value adjustment rate.

The adjusting of a value of value of the input image signal may include calculating the value adjustment rate corresponding to the calculated saturation value by using the value adjustment algorithm, and decreasing an R coordinate value, a G coordinate value, and a B coordinate value with respect to the input image signal represented by an RGB color space by using the calculated value adjustment rate.

The method may further include driving a display panel based on an input image signal in which the value of value is adjusted.

According to another aspect of the inventive concept, there is provided an apparatus for processing a value adjustment signal, which includes a saturation operation unit for operating a saturation value from an image signal represented by an RGB color space, a value decrease rate calculation unit for calculating a value adjustment rate corresponding to an operated saturation value by using a value adjustment algorithm for determining the value adjustment rate according to a saturation value, and a value adjustment unit for adjusting each of an R coordinate value, a G coordinate value, and a B coordinate value of the input image signal represented by the RGB color space by using the calculated value adjustment rate.

The first color space may include a hue, saturation, and value (HSV) color space, a hue, saturation, and lightness (HSL) color space, or a hue, saturation, and intensity (HSI) color space.

The value adjustment algorithm May determine the value adjustment rate to allow a rate of decrease of value to linearly or non-linearly increase as the saturation value decreases.

According to another aspect of the inventive concept, there is provided an image display system which includes a value adjustment signal processing unit for generating a second image signal in which value is adjusted based on a saturation value of a first image signal that is input by using a value adjustment algorithm for determining the value adjustment rate according to a saturation value, a source driving unit for generating a data line driving voltage corresponding to the second image signal, a gate driving unit for generating a scan signal for selecting a gate line, and a display panel for displaying an image in response to the data line driving voltage and a scan signal.

The value adjustment algorithm may determine the value adjustment rate to allow a rate of decrease of value to linearly or non-linearly increase as the saturation value decreases.

According to another aspect of the inventive concept, there is provided an image display system which includes a value adjustment signal processing unit for generating a second image signal in which value is adjusted based on a saturation value of a first image signal that is input by using a value adjustment algorithm for determining the value adjustment rate according to a saturation value, a source driving unit for generating a data line driving voltage corresponding to the second image signal, a gate driving unit for generating a scan signal for selecting a gate line, and a display panel for displaying an image in response to the data line driving voltage and a scan signal.

The value adjustment signal processing unit may include a first color space converter for converting an image signal represented by an RGB color space into a first image signal represented by a first color space including at least a saturation coordinate and a value-related coordinate, a value decrease rate calculation unit for calculating a value adjustment rate corresponding to a saturation coordinate value of the first image signal represented by the first color space by using a value adjustment algorithm for determining the value adjustment rate according to a saturation value, a value adjustment unit for generating a second image signal represented by a first color space in which a value-related coordinate of a first image signal represented by the first color space is adjusted by using the calculated value adjustment rate, and a second color space converter for converting a second image signal represented by the first color space into a second image signal represented by the RGB color space.

The value adjustment signal processing unit may include a saturation operation unit for operating a saturation value from the first image signal represented by the RGB color space, a value adjustment rate calculation unit for calculating a value adjustment rate corresponding to an operated saturation value by using a value adjustment algorithm for determining the value adjustment rate according to a saturation value, and a value adjustment unit for generating the second image signal represented by the RGB color space in which each of an R coordinate value, a G coordinate value, and a B coordinate value of the first input image signal represented by the RGB color space by using the calculated value adjustment rate.

According to another aspect of the inventive concept, there is provided a computer readable recording medium having recorded thereon a program code to execute a method of adjusting value, which includes calculating a value of saturation from an input image signal, and adjusting a value of value of the input image signal according to a calculated saturation value, wherein the value of value of the input image signal is adjusted by using a value adjustment algorithm for determining a value adjustment rate that decreases the value according to the saturation value.

It is noted that aspects of the invention described with respect to one embodiment, may be incorporated in a different embodiment although not specifically described relative thereto. That is, all embodiments and/or features of any embodiment can be combined in any way and/or combination. These and other objects and/or aspects of the present invention are explained in detail in the specification set forth below.

BRIEF DESCRIPTION OF THE DRAWINGS

The accompanying figures are included to provide a further understanding of the present invention, and are incorporated in and constitute a part of this specification. The drawings illustrate some embodiments of the present invention and, together with the description, serve to explain principles of the present inventive concept in which.

DETAILED DESCRIPTION OF THE EMBODIMENTS

Figure 1:
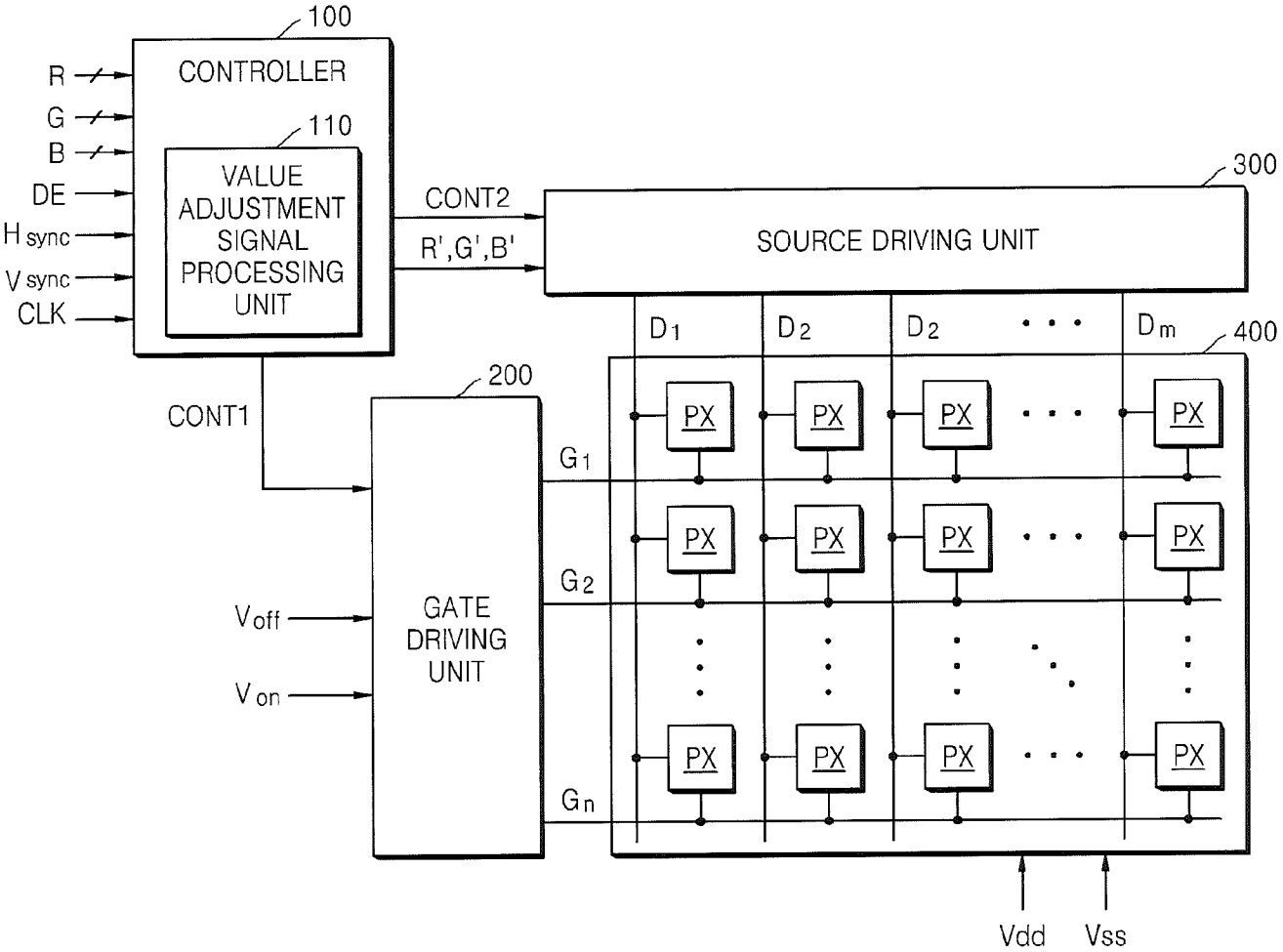
FIG. 1 is a block diagram illustrating the structure of an image display system according to some embodiments of the inventive concept.

The present inventive concept now will be described more fully hereinafter with reference to the accompanying drawings, in which embodiments of the inventive concept are shown. However, this inventive concept should not be construed as limited to the embodiments set forth herein. Rather, these embodiments are provided so that this disclosure will be thorough and complete, and will fully convey the scope of the inventive concept to those skilled in the art.

It will be understood that, although the terms first, second, etc. may be used herein to describe various elements, these elements should not be limited by these terms. These terms are only used to distinguish one element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or "comprises" is open-ended, and includes one or more stated elements, steps and/or functions without precluding one or more unstated elements, steps and/or functions. The term "and/or" includes any and all combinations of one or more of the associated listed items.

It will also be understood that when an element is referred to as being "connected" to another element, it can be directly connected to the other element or intervening elements may be present. In contrast, when an element is referred to as being "directly connected" to another element, there are no intervening elements present. It will also be understood that the sizes and relative orientations of the illustrated elements are not shown to scale, and in some instances they have been exaggerated for purposes of explanation.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein. The present inventive concept will now be described more fully hereinafter with reference to the accompanying drawings, in which embodiments of the inventive concept are shown. This inventive concept, however, may be embodied in many different forms and should not be construed as limited to the embodiments set forth herein. Rather, these embodiments are provided so that this disclosure will be thorough and complete, and will fully convey the scope of the inventive concept to those skilled in the art.

It should be construed that forgoing general illustrations and following detailed descriptions are exemplified and an additional explanation of claimed inventive concepts is provided.

Reference numerals are indicated in detail in some embodiments of the present inventive concept, and their examples are represented in reference drawings. Throughout the drawings, like reference numerals are used for referring to the same or similar elements in the description and drawings.

FIG. 1 is a block diagram illustrating the structure of image display systems according to some embodiments of the inventive concept. Referring to FIG. 1, the image display system according to some embodiments includes a controller 100, a gate driving unit 200, a source driving unit 300, and a display panel 400.

The display panel 400 may be embodied by using a self-illumination element such as an organic light emitting diode (OLED) or a non-self-illumination element such as liquid crystal display (LCD). In the present inventive concept, a display panel using an OLED is described as an exemplary embodiment. The present inventive concept is not limited thereto and may be applied to a display panel using various self-illumination elements or non-self-illumination elements.

The display panel 400 has a structure in which a plurality of signal lines and a plurality of driving voltage lines (not shown) are connected to a plurality of pixels PX in a matrix format. The signal lines include a plurality of gate signal lines $G_1$-$G_n$ for transmitting a scan signal and a plurality of data signal lines $D_1$-$D_m$ for transmitting a data voltage. The driving voltage lines transmit a driving voltage Vdd and a common voltage Vss to each of the pixels PX.

Figure 2:
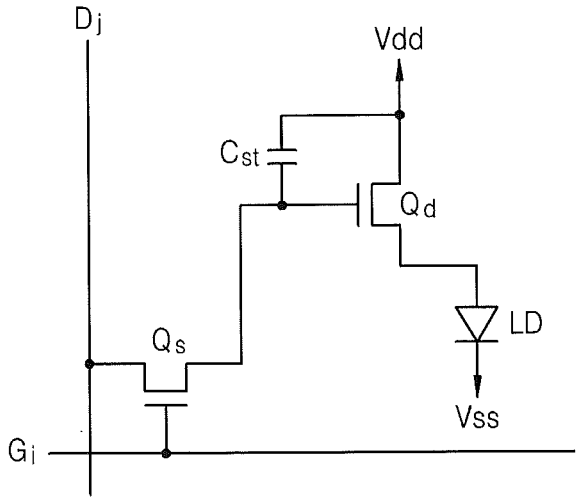
FIG. 2 is an equivalent circuit diagram of a pixel of the image display system of FIG. 1.

FIG. 2 illustrates an equivalent circuit to the pixels PX included in the display panel 400. Referring to FIG. 2, a pixel connected to a gate signal line $G_i$ and a data signal line $D_j$ includes an OLED LD, transistors $Q_d$ and $Q_s$, and a capacitor C. The transistor $Q_d$ is a three-terminal device having a control terminal connected to an output terminal of the transistor $Q_s$ and the capacitor $C_{st}$, an input terminal connected to the driving voltage Vd, and an output terminal connected to the OLED LD.

The transistor $Q_s$ is also a three-terminal device having a control terminal connected to the gate signal line $G_i$, an input terminal connected to the data signal line $D_j$, and an output terminal connected to the capacitor $C_{st}$ and a control terminal of the transistor $Q_d$. The capacitor $C_{st}$ is connected between the control terminal of the transistor $Q_d$ and the driving voltage Vdd and charges and maintains the data voltage for a predetermined time during which the transistor $Q_s$ is turned on.

An anode terminal and a cathode terminal of the OLED LD are connected to the output terminal of the transistor $Q_d$ and the common voltage Vss. The OLED LD has a characteristic that the intensity of light emission varies according to the amount of current supplied by the transistor $Q_d$. The amount of the current supplied by the transistor $Q_d$ varies according to the voltage charged in the capacitor $C_{st}$. Accordingly, as the intensity of light emission of the OLED LD varies according to the data voltage, an image corresponding to the data voltage is displayed.

The transistors $Q_d$ and $Q_s$ may be embodied by n-channel field effect transistors (FETs) that are formed of amorphous silicon or polycrystal silicon. The transistors $Q_d$ and $Q_s$ may be embodied by n-channel FETs.

Referring back to FIG. 1, the gate driving unit 200 applies, to the gate signal lines $G_1$-$G_n$, a scan signal that is formed of a combination of a voltage $V_{on}$ for turning on the transistor $Q_s$ connected to the gate signal lines $G_1$-$G_n$ or a voltage $V_{off}$ for turning the transistor $Q_s$ off, in response to a scan control signal CONT1. The source driving unit 300 applies the data voltage to the data signal lines $D_1$-$D_m$, in response to a data control signal CONT2.

The gate driving unit 200 or the source driving unit 300 may be installed on the display panel 400 in the form of at least one integrated circuit (IC) chip, or in the form of a tape carrier package (TCP) that may be installed thereon. Also, the gate driving unit 200 or the source driving unit 300 may be designed to be directly integrated on the display panel 400.

The controller 100 controls the operations of the gate driving unit 200 and the source driving unit 300. The controller 100 receives control signals such as input image signals R, G, and B, a vertical sync signal Vsync, a horizontal sync signal Hsync, a clock signal CLK, and a data enable signal DE, from an external graphic controllers (not shown). The controller 100 performs signal processing to adjust values of the input image signals R, G, and B by using a value adjustment algorithm for determining a value adjustment rate to reduce the value based on a saturation value, transmits the data control signal CONT2 and image signals R', G', and B' in which values corresponding to value are adjusted, to the source driving unit 300, and transmits the scan control signal CONT1 to the data driving unit 200.

The signal processing performed to adjust values of the input image signals R, G, and B by using the value adjustment algorithm is performed in the value adjustment signal processing unit 110 of the controller 100, which will be described later in detail. Although the value adjustment signal processing unit 110 may be included in the IC chip of the controller 100, it may be arranged separately from the IC chip of the controller 100.

The scan control signal CONT1 includes a vertical sync start signal indicating scan start and a clock signal related to timing of generation of the voltage $V_{on}$ for turning the transistor $Q_s$ on or the voltage $V_{off}$ for turning the transistor $Q_s$ off. The data control signal CONT2 includes a horizontal sync start signal indicating transmission of data of one pixel row and a load signal indicating application of a corresponding data voltage to the data signal lines $D_1$-$D_m$.

The source driving unit 300 receives the image signals R', G', and B' with respect to the pixels of one row in response to the data control signal CONT2, converts the image signals R', G', and B', which are digital signals, into analog data signals, and applies the analog data signals to the data signal lines $D_1$-$D_m$. The gate driving unit 200 applies a scan signal to the gate signal lines $G_1$-$G_n$ in response to the scan control signal CONT1 and turns on the transistor $Q_s$ connected to the gate signal lines $G_1$-$G_n$.

Accordingly, the data voltage applied to the data signal lines $D_1$-$D_m$ is applied to the control terminal of the transistor $Q_d$ via the transistor $Q_s$ that is turned on. The data voltage applied to the control terminal of the transistor $Q_d$ is charged in the capacitor $C_{st}$ and the charged voltage is maintained even when the transistor $Q_s$ is turned off. Thus, the transistor $Q_d$ to which the data voltage is applied is turned on, and thus, current depending on the data voltage is output to the OLED LD. As the current flows in the OLED LD, a corresponding pixel PX displays an image.

When one horizontal sync cycle passes, the gate driving unit 200 and the source driving unit 300 repeat the same operation as above with respect to pixels PX of the next row. For reference, in FIG. 1, a pixel PX includes three circuits, each being the same as that shown in FIG. 2, to display the respective R, G, and B signals. That is, three dots displaying the R, G, and B signals form a single pixel. The value adjustment algorithm according to the present inventive concept is described now.

The amount of current consumption by the OLED that is an example of a self-illumination element reaches a maximum when the voltage applied to each of the R, G, and B dots reaches a maximum. The value adjustment algorithm of the present inventive concept is to reduce current consumption by smoothly changing a white value to a low gray scale value ("the value"). In some embodiments, the value may include more broadly, an input image signal value.

There are many ways to reduce the value. However, to prevent distortion of an image or generation of color shift during the reduction of the value, a regular rate of decrease of the value is applied to all pixels. Accordingly, some embodiments of the present inventive concept provide a value adjustment algorithm that adjusts the rate of decrease of the value according to saturation while maintaining hue and saturation without change.

First, a value adjustment algorithm that accompanies a process of converting color space according to some embodiments of the present inventive concept is described below.

When an algorithm for adjusting the value by converting an R, G, and B color space into a color space such as hue, saturation, and value (HSV) or hue, saturation, and lightness (HSL) in which the value is easily handled is employed, a numerical formula can be simplified.

An HSV color space is a method of representing an image signal by using information on hue, saturation, and value. That is, the HSV color space represents an image signal by using a hue coordinate, a saturation coordinate, and a value coordinate.

An HSL color space is a method of representing an image signal by using information on hue, saturation, and lightness. That is, the HSL color space represents an image signal by using a hue coordinate, a saturation coordinate, and a lightness coordinate.

An HSI color space is a method of representing an image signal by using information on hue, saturation, and intensity. That is, the HSI color space represents an image signal by using a hue coordinate, a saturation coordinate, and an intensity coordinate.

An HSB color space is a method of representing an image signal by using information on hue, saturation, and brightness. That is, the HSB color space represents an image signal by using a hue coordinate, a saturation coordinate, and a brightness coordinate.

The value is defined as the largest value of the R, G, and B values. The lightness is defined as an average value between the largest value and the smallest value of the R, G, and B values. The intensity is an average value obtained by summing the R, G, and B values and dividing the sum by 3. The brightness has the same meaning as the value. Thus, the value, the lightness, and the intensity may be understood as information having the same characteristic. Accordingly, in the present inventive concept, the value coordinate, the lightness coordinate, and the intensity coordinate are classified as coordinates related to the value.

The value adjustment algorithm according to some embodiments of the present inventive concept is described in detail with reference to the HSV color space. The HSV color space may be represented by using cylindrical coordinates as shown in FIG. 3.

Figure 3:
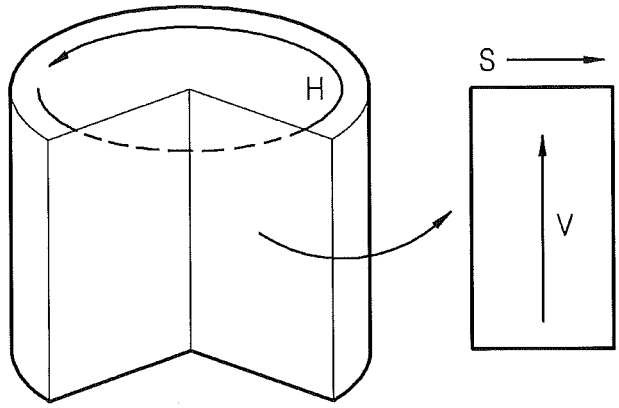
FIG. 3 illustrates cylindrical coordinates of a hue, saturation, and value (HSV) color space used in some embodiments of the present inventive concept.

In FIG. 3, a partially cut-away cylinder in the left is the HSV color space in which three coordinates of a hue coordinate H, a saturation coordinate S, and a value coordinate V are represented by a cylindrical coordinate, whereas a rectangular plane in the right shows only the saturation coordinate S and the value coordinate V. In FIG. 3, white that consumes power most is distributed at the center of the top surface of the cylinder. A value adjustment algorithm to reduce power consumption in this area is described below with reference to FIG. 4.

Figure 4:
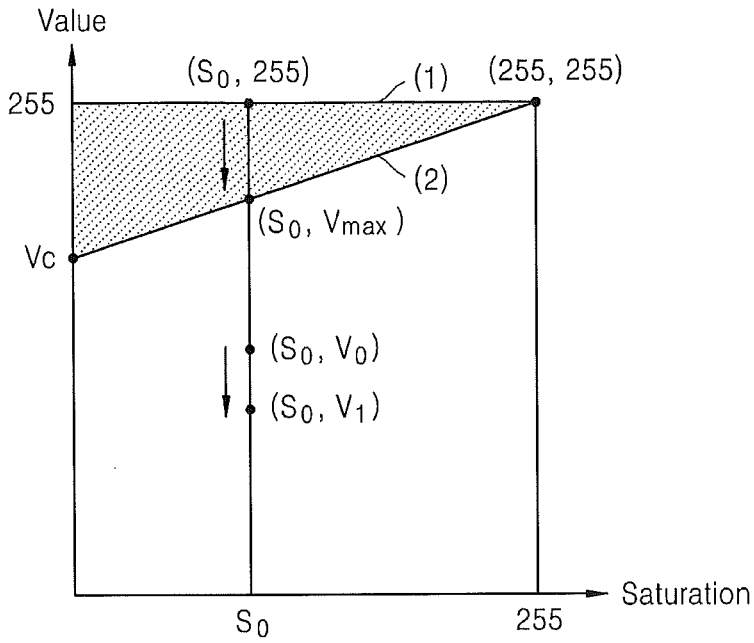
FIG. 4 is a graph showing saturation and value in the HSV color space represented in plane coordinates to describe a value adjustment algorithm, according to some embodiments of the inventive concept.

FIG. 4 shows that only the saturation coordinate S and the value coordinate V are represented by using plane coordinates in the HSV color space. Some embodiments provide that each of R, G, and B may have a width of 8 bits, however, R, G and/or B may include more and/or less than 8 bits within the scope and spirit of the present inventive concept.

The value adjustment algorithm provided by the present inventive concept determines a value adjustment rate according to a saturation value and determines a value adjustment rate such that the rate of decrease of value can increase linearly or non-linearly as the saturation value decreases.

Referring to FIG. 4, the value adjustment algorithm that determines the rate of decrease of the value to be at a minimum on the condition that a saturation value is at a maximum in the HSV color space, and determines a value adjustment rate such that the rate of decrease of the value can increase linearly as the saturation value decreases, is described.

In FIG. 4, a line (1) denotes the maximum value that can be displayed regardless of a saturation value before adjustment of the value, and a line (2) denotes the maximum value that can be displayed according to a saturation value after the adjustment of the value. The line (2) indicates a gray scale adjustment line. That is, a value adjustment rate is determined according to the line (2), which will be described below.

Assuming that the maximum value that can be displayed is Vc when the saturation value is 0, and that the maximum value that can be displayed is 255 when the saturation value is at the maximum of 255, the line (2) is a straight line connecting a coordinate (0, Vc) and a coordinate (255, 255). According to the line (2), the maximum value that can be displayed is reduced to Vc from 255 when the saturation value is 0, and the maximum value that can be displayed is reduced to $V_{max}$ from 255 when the saturation value is $S_0$.

When the maximum value that can be displayed is changed from the line (1) to the line (2), the value decreases by as much as the rate of decrease of the maximum value at a corresponding saturation value, according to the saturation value. For example, the value $V_0$ of the original coordinate ($S_0$, $V_0$) before the adjustment of value is changed to $V_1$ is reduced at the same rate of decrease of the maximum value at the saturation value of $S_0$ after the adjustment of value according to the line (2). That is, the original coordinate ($S_0$, $V_0$) before the adjustment of value is changed to a coordinate ($S_0$, $V_1$). Then, the line (2) can be expressed as in Equation 1.

$$V_{max}\{(255-Vc)/255\}\times S_0+Vc \quad \text{[Equation 1]}$$

When the original coordinate ($S_0$, $V_0$) before the adjustment of the value according to the line (1) is changed to the coordinate ($S_0$, $V_1$) after the adjustment of the value, the $V_1$ in which the value coordinate is adjusted can be expressed as in Equation 2.

$$V_1=(V_0/255)\times V_{max} \quad \text{[Equation 2]}$$

The value adjustment rate for the saturation value $S_0$ is $V_{max}/255$. In the present inventive concept, the value adjustment rate may be determined to be a value equal to or greater than "0" and equal to or less than "1" according to the saturation value. When the value adjustment rate is "1", the decrease of the value is not generated. When the value adjustment rate is "0", the decrease of the value is generated most and thus the value becomes "0". Thus, as the value adjustment rate approaches "0", a rate of decrease of the value increases. As the value adjustment rate approaches "1", the rate of decrease of the value decreases.

When the $V_{max}$ of Equation 1 is substituted in Equation 2, Equation 3 is obtained as follows.

$$V_1=[\{(255-Vc)/255\}\times S_0+Vc]\times(V_0/255) \quad \text{[Equation 3]}$$

Thus, since Vc is an already known value, the value $V_1$ after the adjustment of the value may be obtained by Equation 3 from the original coordinate ($S_0$, $V_0$) before the adjustment of the value. A ratio between the length (255) of a line connecting the coordinate ($S_0$, 255) and the coordinate ($S_0$, 0) and the length $V_{max}$ of a line connecting the coordinate ($S_0$, $V_{max}$) and the coordinate ($S_0$, 255) may be calculated. The coordinate ($S_0$, $V_1$) in which the value is adjusted is obtained by applying the ratio to the coordinate ($S_0$, $V_0$), the value is decreased without color shift.

In FIG. 4, according to the line (2), it can be seen that, when the value is adjusted, the rate of decrease of the value increases as the saturation value approaches "0" and the rate of decrease of value decreases as the saturation value approaches "255". When the value is adjusted according to the above algorithm, a white component decreases and no change is generated in saturation and hue, thereby maintaining a clear color.

The value adjustment algorithm according to the present inventive concept may use a line (2) of FIGS. 5A-5D instead of the line (2) for gray scale adjustment as shown in FIG. 4.

Figure 5A:
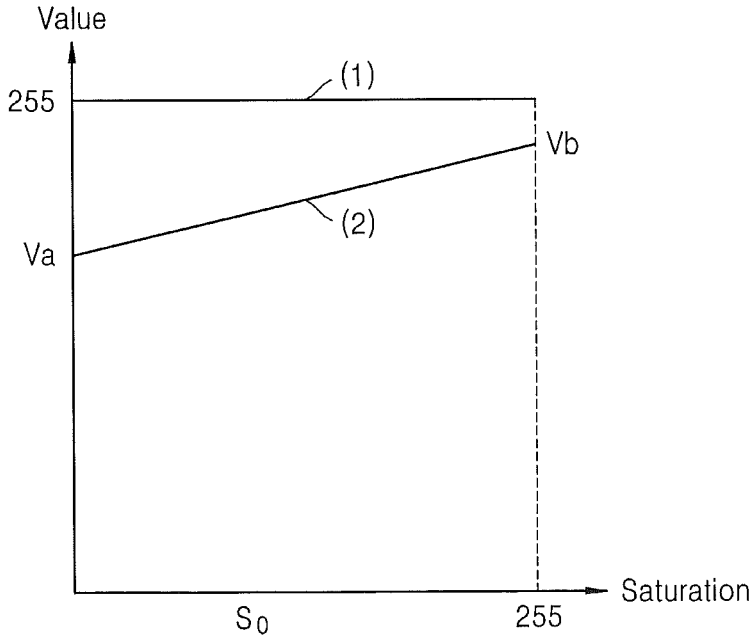
FIGS. 5A-5D are graphs showing various examples of a gray scale adjustment line (2) used for the value adjustment algorithm, according to some embodiments of the inventive concept.

FIG. 5A illustrates a characteristic value adjustment that a value decrease rate linearly increases as a saturation value decreases, in which the value decrease rate is set to be a value that is not "0" on the condition that the Saturation value reaches a maximum. In FIG. 5A, compared to FIG. 4, the value is decreased on the condition that saturation reaches the maximum. That is, when the value is adjusted using a line (2) of FIG. 5A, the value may be adjusted at a rate of decrease of the value from 255 to Va on the condition that the saturation value is "0" and at a rate of decrease of the value from 255 to Vb on the condition that the saturation value is "255".

Figure 5B:
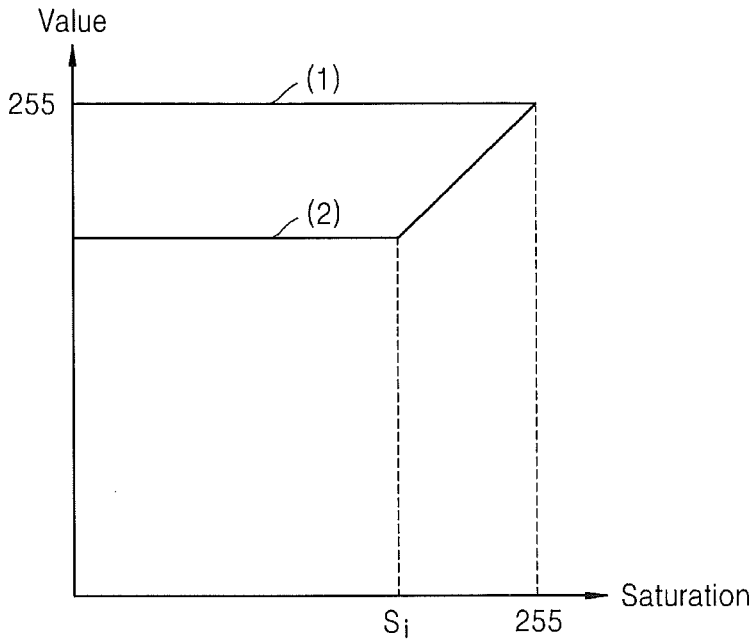

FIG. 5B illustrates a characteristic value adjustment that a value decrease rate linearly increases as a saturation value decreases in a partial section, in which inclination of the line (2) varies according to the saturation value. In FIG. 5B, the adjustment of the value is constant in a section where the saturation value is 0 to $S_i$ and the adjustment of the value linearly varies according to the saturation value in a section where the saturation value is $S_i$ to 255.

Figure 5C:
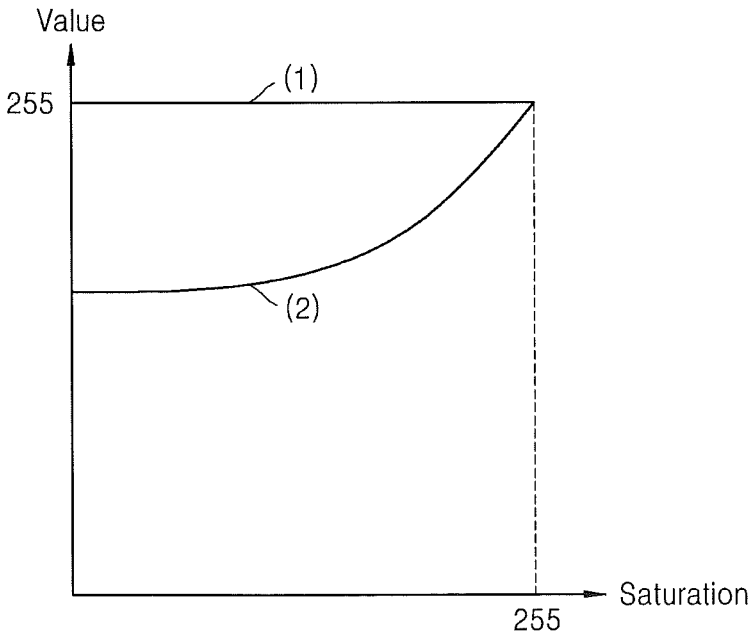

FIG. 5C illustrates a characteristic value adjustment that a value decrease rate increases non-linearly as a saturation value decreases.

Figure 5D:
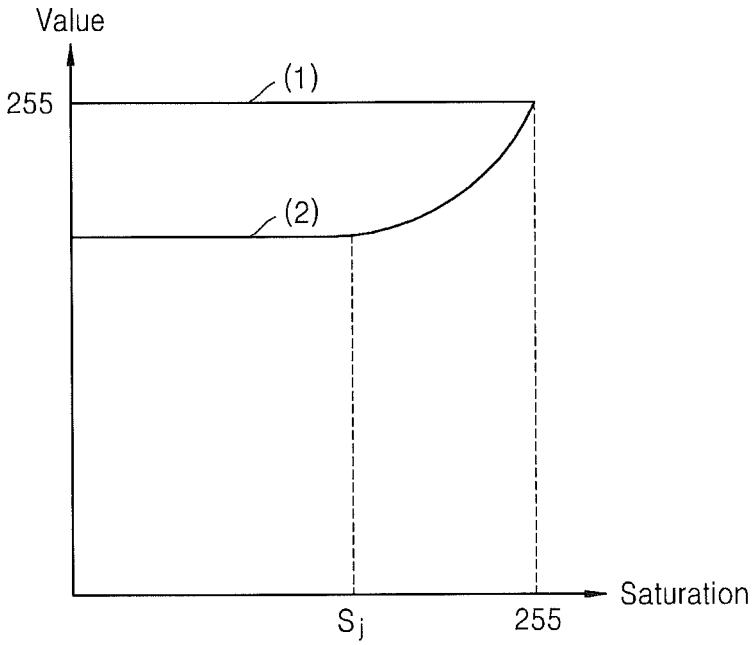

FIG. 5D illustrates a characteristic value adjustment that a value decrease rate increases linearly or non-linearly as a saturation value decreases according to the saturation value. In FIG. 5D, the value decrease rate linearly changes according to the value of saturation in a section where a saturation value is between 0-$S_j$, and the value decrease rate changes non-linearly according to the value of saturation in a section where the saturation value is between $S_j$-255.

A straight line or a curved line having a variety of shapes other than those shown in FIGS. 5A-5D may be used as the line (2) for gray scale adjustment that may be applied to the present inventive concept.

Next, a value adjustment algorithm without a color space conversion process according to another exemplary embodiment of the present inventive concept is described below.

A formula to convert an RGB color space into an HSV color space is shown in Equation 4.

$$h=\begin{cases}0, & \text{if } \max=\min \\ \left(60^\circ\times\dfrac{g-b}{\max-\min}+360^\circ\right)\bmod 360^\circ, & \text{if } \max=r \\ 60^\circ\times\dfrac{b-r}{\max-\min}+120^\circ, & \text{if } \max=g \\ 60^\circ\times\dfrac{r-g}{\max-\min}+240^\circ, & \text{if } \max=b\end{cases} \quad \text{[Equation 4]}$$

$$s=\begin{cases}0, & \text{if } \max=0 \\ \dfrac{\max-\min}{\max}=1-\dfrac{\min}{\max}, & \text{otherwise}\end{cases}$$

$$v=\max$$

In Equation 4, "max" denotes the maximum value of R, G, and B values and corresponds to a V coordinate in the HSV color space and "min" denotes the minimum value of the R, G, and B values. The value V is changed to a particular rate according to the value adjustment algorithm according to the present inventive concept, and the changed value is referred to as V'. When R, G, and B are changed to R', G', and B' by the value adjustment algorithm according to the present inventive concept, the R', G', and B' may be reduced at a constant rate as expressed by Equation 5.

$$R'=\alpha R, G'=\beta G, B'=\gamma B \quad \text{[Equation 5]}$$

For example, it is assumed that R is the "max" value and B is the "min" value. Since saturation is not changed in the HSV color space before and after the application of the value adjustment algorithm according to the present inventive concept, saturations S and S' before and after the application of the value adjustment algorithm are related as expressed by Equation 6.

$$S = 1 - \frac{B}{R} = S' = 1 - \frac{B'}{R'} \quad \text{[Equation 6]}$$

To satisfy Equation 6, a relationship is established as shown in Equation 7.

$$\frac{B}{R} = \frac{B'}{R'} = \frac{\gamma B}{\alpha R} \quad \text{[Equation 7]}$$

It can be seen from Equation 7 that $\gamma=\alpha$. That is, the change rates of the max value and the min value are the same.

Next, since hue H in the HSV color space before and after the application of the value adjustment algorithm according to the present inventive concept is not changed, hues H and H' before and after the application of the value adjustment algorithm are related as expressed by Equation 8.

$$H = 60 \times \frac{G-B}{R-B} = H' = 60 \times \frac{\beta G - \gamma B}{\alpha R - \gamma B} \quad \text{[Equation 8]}$$

As described above, since $\gamma=\alpha$, it can be seen that a relationship like Equation 9 is established from Equation 8.

$$\frac{G-B}{R-B} = \frac{\beta G - \gamma B}{\alpha R - \gamma B} = \frac{\beta G - \alpha B}{\alpha R - \alpha B} \quad \text{[Equation 9]}$$

Thus, $\beta=\alpha=\gamma$.

As shown in the above, when the value adjustment algorithm according to the present inventive concept is applied, a change in hue or saturation may not be generated only when the R, G, and B values are changed at the same rate.

Accordingly, the change rate of the value V may be obtained by obtaining only the value of saturation S without conversion of a color space. By multiplying the change rate of the value V obtained as above to the R, G, and B values, the value according to the saturation value may be adjusted without converting the RGB color space into the HSV color space.

That is, by applying the value adjustment algorithm, the value may be adjusted without passing through a color space conversion process in order of the RGB color space, the HSV color space, and the RGB color space. A value adjustment apparatus and method using the value adjustment algorithm according to the present inventive concept is described in detail.

Referring back to FIG. 1, the value adjustment signal processing unit 110 performs signal processing to adjust the value by applying a value adjustment rate determined according to saturation without a change of saturation and hue and by using the above-described value adjustment algorithm.

Figure 6:
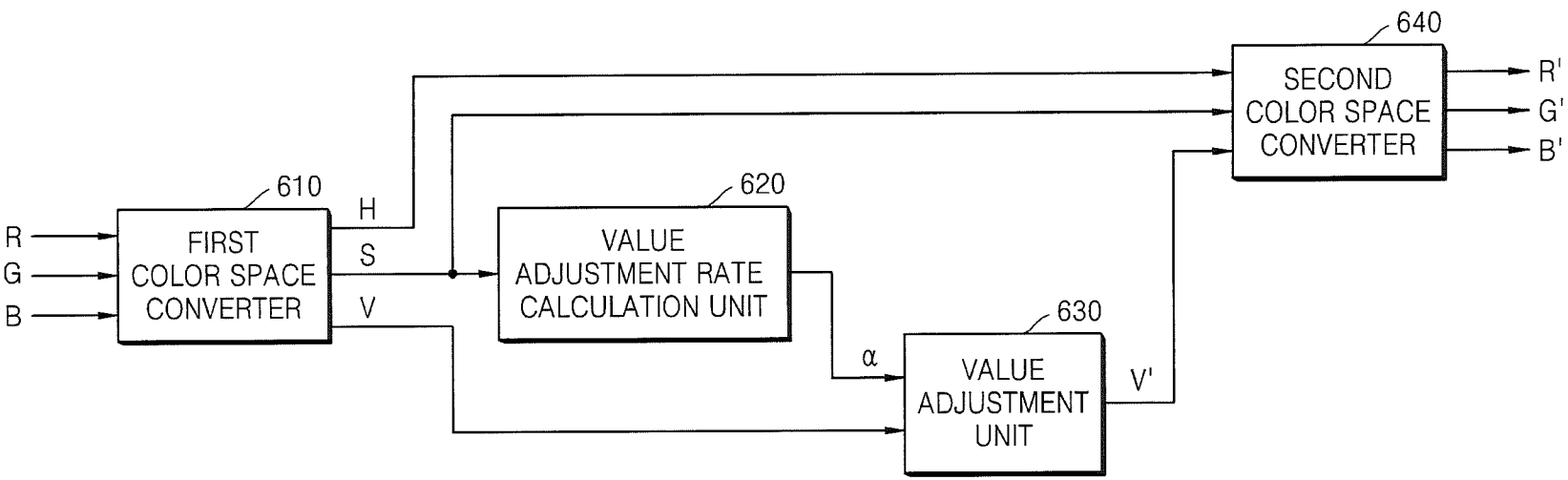
FIG. 6 is a block diagram illustrating the structure of a value adjustment signal processing apparatus according to some embodiments of the inventive concept.

FIG. 6 illustrates a detailed structure of the value adjustment signal processing unit 110 according to some embodiments of the present inventive concept. In the value adjustment signal processing unit 110 of the exemplary embodiment of FIG. 6, a value adjustment algorithm to adjust the value after a process of converting a color space is performed is used.

As shown in FIG. 6, the value adjustment signal processing unit 110 includes a first color space converter 610, a value adjustment rate calculation unit 620, a value adjustment unit 630, and a second color space converter 640. The first color space converter 610 converts an input image signal represented by the RGB color space into an image signal represented by the HSV color space. That is, by applying a color space conversion formula as shown in Equation 4, the input image signal represented by the RGB color space may be converted into an image signal represented by the HSV color space.

The value adjustment rate calculation unit 620 calculates a value adjustment rate for decreasing the value based on a saturation coordinate value of the image signal converted into the HSV color space. The value adjustment rate calculation unit 620 may calculate a value adjustment rate $\alpha$ according to a saturation value by using the value adjustment algorithm for determining the value adjustment rate so that a rate of decrease of the value according to the decreases of a saturation value may increase linearly or non-linearly by using the gray scale adjustment line (2) of FIG. 4 or FIGS. 5A-5D.

As an example, when the value adjustment rate calculation unit 620 uses the scale adjustment line (2) of FIG. 4, the value adjustment rate $\alpha$ with respect to the saturation value $S_0$ becomes $V_{max}/255$. In detail, the value adjustment rate $\alpha$ may be calculated through an operation such as $[\{(255-Vc)/255\}\times S_0+Vc]/255$ by referring to Equation 3.

The value adjustment rate calculation unit 620 may calculate the value adjustment rate $\alpha$ according to a saturation value from the operation described above. The value adjustment rate $\alpha$ corresponding to the saturation value may be obtained from a lookup table in which the value adjustment rate according to the saturation value is set. The lookup table may set the value adjustment rate such that the rate of decrease of value according to the decreases of a saturation value may increase linearly or non-linearly as in the gray scale adjustment line (2) of FIG. 4 or FIGS. 5A-5D.

The value adjustment unit 630 performs an operation to reduce a coordinate value of the value of the image signal converted into the HSV color space by applying the value adjustment rate $\alpha$ calculated by the value adjustment rate calculation unit 620. That is, the value adjustment unit 630 generates a value coordinate value V' in which the value is adjusted by multiplying the value V of the image signal converted into the HSV color space by the value adjustment rate $\alpha$ calculated by the value adjustment rate calculation unit 620.

The second color space converter 640 receives a hue coordinate value H and a saturation coordinate value S which are output from the first color space converter 610, and the value coordinate value V' output from the value adjustment unit 630, and converts the received values into the RGB color space. The image signals R', G', and B' represented by the RGB color space that are converted by the second color space converter 640 are output to the source driving unit 300 of FIG. 1, thereby driving the display panel 400.

Figure 7:
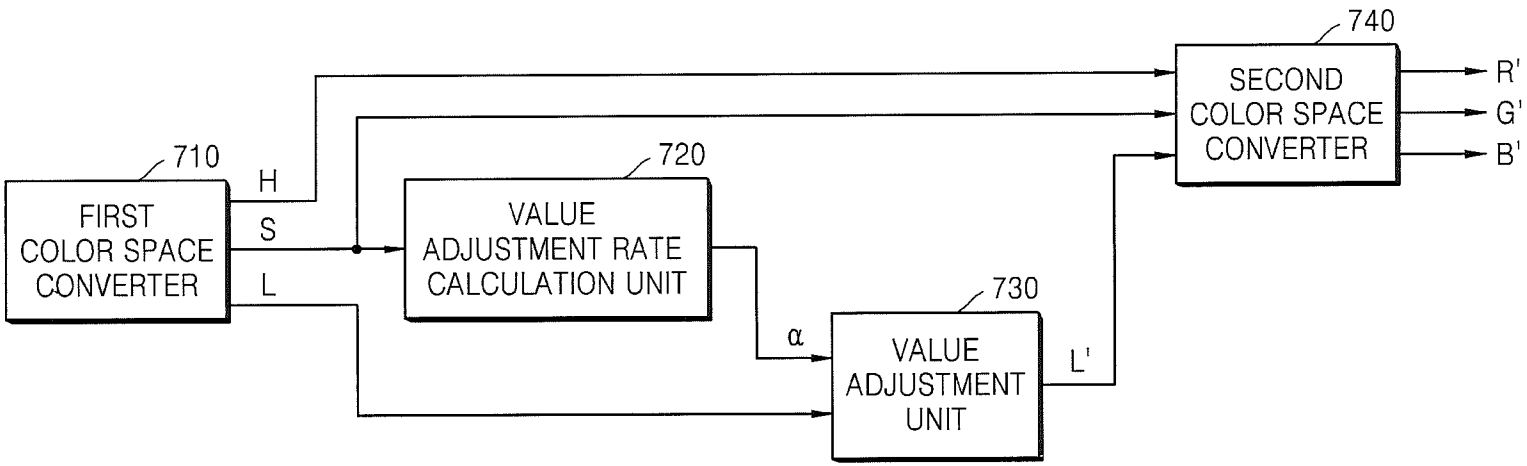
FIG. 7 is a block diagram illustrating the structure of a value adjustment signal processing apparatus according to further embodiments of the inventive concept.

FIG. 7 illustrates a detailed structure of the value adjustment signal processing unit 110 according to further embodiments of the present inventive concept. In some embodiments of FIG. 7, a value adjustment algorithm to adjust value after a process of converting a color space is performed is used.

As shown in FIG. 7, the value adjustment signal processing unit 110 includes a first color space converter 710, a value adjustment rate calculation unit 720, a value adjustment unit 730, and a second color space converter 740. The first color space converter 710 converts an input image signal represented by the RGB color space into an image signal represented by the HSL color space. In the HSV color space, the value is defined as the largest value of R, G, and B values. In the HSL color space, lightness is defined as an average value between the largest and smallest values of R, G, and B values. Hue and saturation may have substantially identical characteristics. Lightness is information that may include the same characteristic as the value. Thus, the adjustment of the value and the adjustment of lightness may be understood as substantially similar concepts.

The value adjustment rate calculation unit 720 calculates a value adjustment rate for decreasing value based on a saturation coordinate value of the image signal converted into the HSL color space. The value adjustment rate calculation unit 720 may calculate a value adjustment rate $\alpha$ according to a saturation value based on the value adjustment algorithm for determining the value adjustment rate so that a rate of decrease of the value may increase linearly or non-linearly as the saturation value decreases as indicated by the gray scale adjustment line (2) of FIG. 4 or FIGS. 5A-5D. By substituting the value coordinate V of FIG. 4 or FIGS. 5A-5D by a lightness coordinate L in the HSL color space and by using the lightness L instead of the value V in Equations 1-3, the value adjustment rate $\alpha$ may be calculated according to the above-described principle using the value adjustment rate calculation unit 620 of FIG. 6.

The value adjustment unit 730 performs an operation to adjust a lightness coordinate value of the image signal converted into the HSL color space by applying the value adjustment rate $\alpha$ calculated by the value adjustment rate calculation unit 720. That is, the value adjustment unit 730 generates a lightness coordinate value L' in which the value is adjusted by multiplying the lightness value L of the image signal converted into the HSL color space by the value adjustment rate $\alpha$ calculated by the value adjustment rate calculation unit 720.

The second color space converter 740 receives a hue coordinate value H and a saturation coordinate value S which are output from the first color space converter 710, and the lightness coordinate value L' output from the value adjustment unit 730, and converts the received values into the RGB color space. The image signals R', G', and B' represented by the RGB color space, which are converted by the second color space 740, are output to the source driving unit 300 of FIG. 1, thereby driving the display panel 400.

Figure 8:
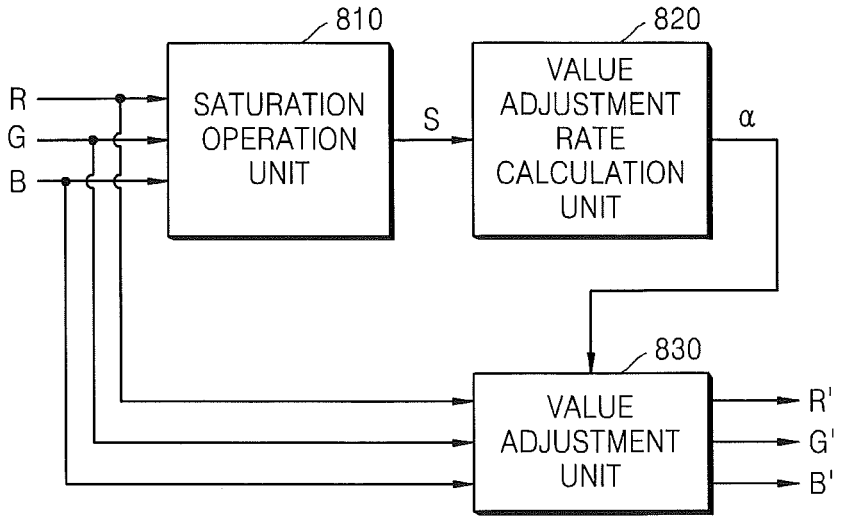
FIG. 8 is a block diagram illustrating the structure of a value adjustment signal processing apparatus according to yet further embodiments of the inventive concept.

FIG. 8 illustrates a detailed structure of the value adjustment signal processing unit 110 according to yet further embodiments of the present inventive concept. In the some embodiments of FIG. 8, a value adjustment algorithm to adjust the value without performing a process of converting a color space is used.

As shown in FIG. 8, the value adjustment signal processing unit 110 includes a saturation operation unit 810, a value adjustment calculation unit 820, and a value adjustment unit 830.

The saturation operation unit 810 operates a saturation value S from the input image signal R, G, and B represented by the RGB color space. That is, the saturation operation unit 810 operates the saturation value S according to an operation formula for obtaining the saturation value S of Equation 4 from the image signals R, G, and B represented by the RGB color space, without converting a color space.

The value adjustment calculation unit 820 calculates the value adjustment rate a to decrease the value based on the saturation value S operated by the saturation operation unit 810. The value adjustment calculation unit 820 may calculate a value adjustment rate a according to a saturation value based on the value adjustment algorithm for determining the value adjustment rate so that a rate of decrease of the value may increase linearly or non-linearly as the saturation value decreases as indicated by the gray scale adjustment line (2) of FIG. 4 or FIGS. 5A-5D. Since the operation of the value adjustment calculation unit 820 is substantially the same as that of the value adjustment rate calculation unit 620 of FIG. 6, a description thereof will be omitted herein.

The value adjustment unit 830 generates R', G', and B' in which the value is adjusted, by adjusting each of the R, G, and B of the input image signal represented by the RGB color space according to the value adjustment rate $\alpha$ calculated by the value adjustment calculation unit 820. That is, the value adjustment unit 830 generates R', G', and B' in which the value is adjusted, by multiplying each of the R, G, and B of the input image signal represented by the RGB color space by the value adjustment rate $\alpha$. The value adjusted R', G', and B' are output to the source driving unit 300 of FIG. 1, thereby driving the display panel 400.

Figure 9:
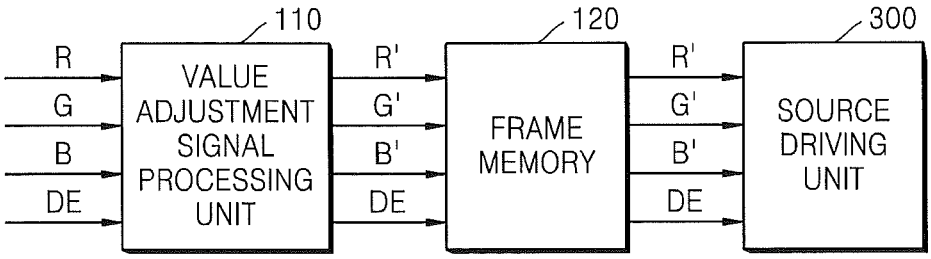
FIGS. 9-11 are block diagrams illustrating a variety of arrangements of the value adjustment signal processing apparatus in a display driving controller, according to some embodiments of the inventive concept.
Figure 10:
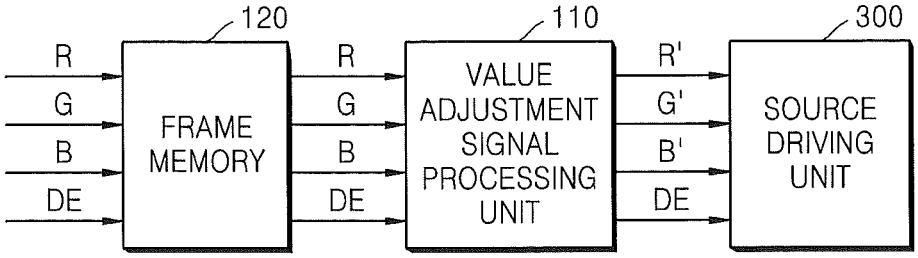
Figure 11:
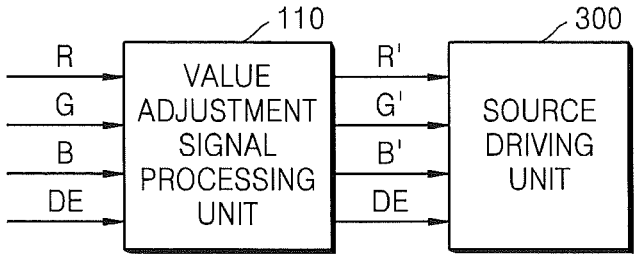

The value adjustment signal processing unit 110 of FIGS. 6-8 may be arranged as shown in FIGS. 9-11 in the controller 100 for driving a display.

FIG. 9 illustrates an arrangement that the value adjustment signal processing unit 110 is arranged at the front end of a frame memory 120. FIG. 10 illustrates an arrangement that the value adjustment signal processing unit 110 is arranged at the rear end of the frame memory 120. FIG. 11 illustrates an arrangement of the value adjustment signal processing unit 110 when a frame memory is not included.

When the value adjustment signal processing unit 110 is arranged at the front end of a frame memory 120, the value adjustment signal processing unit 110 executes value adjustment signal processing only when a data enable signal DE is applied so that power consumption may be reduced.

When the value adjustment signal processing unit 110 is arranged at the rear end of the frame memory 120, although power consumption increases due to continuous toggling of an oscillation clock, it is advantageous that a result of adjustment of value may be generated in real time.

Also, the value adjustment signal process may be performed without including a frame memory as shown in FIG. 11. Next, a value adjustment method according to some embodiments of the present inventive concept is described with reference to the flowcharts of FIGS. 12 and 13.

Figure 12:
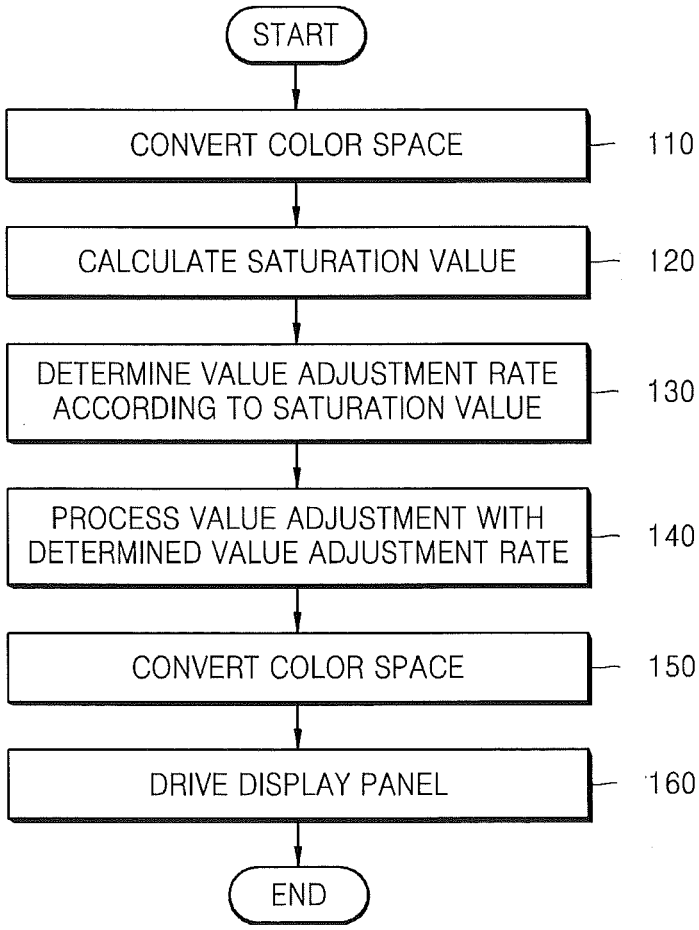
FIG. 12 is a flowchart for explaining value adjustment methods according to some embodiments of the inventive concept.
Figure 13:
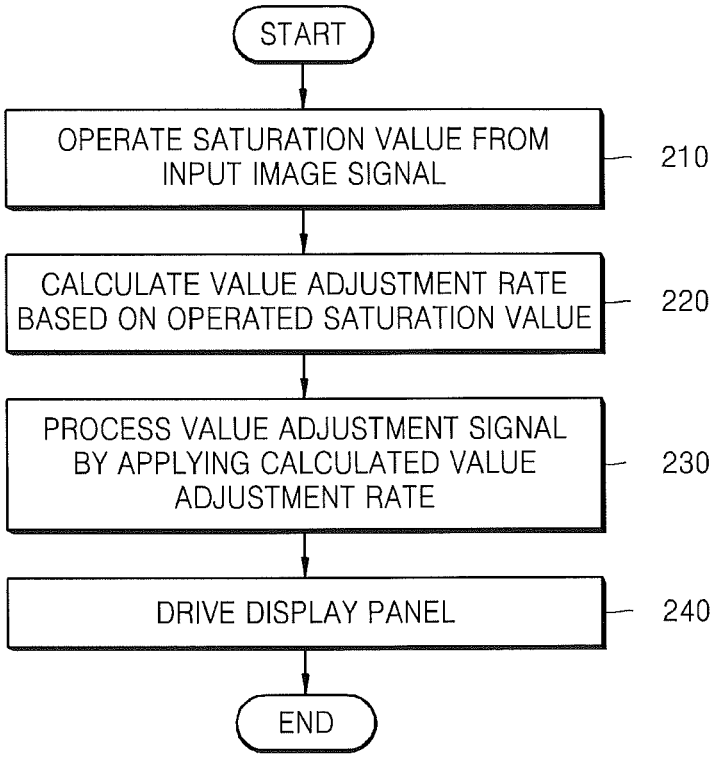
FIG. 13 is a flowchart for explaining value adjustment methods according to further embodiments of the inventive concept.

FIG. 12 is a flowchart for explaining value adjustment methods with the conversion of a color space, according to some embodiments of the inventive concept. FIG. 13 is a flowchart for explaining value adjustment methods without the conversion of a color space, according to some embodiments of the inventive concept.

Referring to FIG. 12, a signal process of converting an input image signal represented by the RGB color space into an image signal represented by a color space including at least a saturation coordinate and a value-related coordinate is performed (Operation 110). The color space including at least a saturation coordinate and a value-related coordinate may include an HSV color space, an HSL color space, an HSI color space, and/or an HSB color space. The lightness of the HSL color space, the intensity of the HSI color space, and the value of the HSV color space are not the same value, but they may be used in the same manner as the concept described above. In some embodiments of the present inventive concept, the value adjustment is performed on the assumption that the lightness and the intensity are the same as the value.

Accordingly, in operation 110, the input image signal represented by the RGB color space is converted into the image signal represented by the HSV color space or HSL color space.

Next, in the image signal represented by the HSV color space or HSL color space, a saturation coordinate value S is determined as a saturation value of the input image signal (Operation 120). A value adjustment rate is determined according to the saturation value determined in operation 120 (Operation 130). In detail, by using the gray scale adjustment line (2) of FIG. 4 or FIGS. 5A-5D, a value adjustment rate according to a saturation value may be calculated based on the value adjustment algorithm for determining the value adjustment rate so that a rate of decrease of the value may increase linearly or non-linearly as the saturation value decreases. For example, when the value adjustment rate calculation unit 620 uses the scale adjustment line (2) of FIG. 4, the value adjustment rate with respect to the saturation value $S_0$ becomes $V_{max}/255$ as in Equation 2. In detail, referring to Equation 3, the value adjustment rate may be calculated through an operation such as $[\{(255-Vc)/255\}\times S_0+Vc]/255$.

Also, the value adjustment rate corresponding to the saturation value may be obtained from a lookup table in which the value adjustment rate according to the saturation value is set. The lookup table may set the value adjustment rate such that the rate of decrease of the value according to the decreases of a saturation value may increase linearly or non-linearly by using the gray scale adjustment line (2) of FIG. 4 or FIGS. 5A-5D.

Next, signal processing for value adjustment is performed by applying the value adjustment rate determined in operation 130 (Operation 140). That is, the value may be adjusted by multiplying the value coordinate value of the image signal converted into the HSV color space by the value adjustment rate. Also, the value may be adjusted by multiplying a lightness coordinate value of the image signal converted into the HSL color space by the value adjustment rate.

Next, the image signal represented by the value adjusted HSV color space or HSL color space is converted into the image signal represented by the RGB color space (Operation 150). The display panel is driven based on the image signal represented by the RGB color space in which the value is adjusted in operation 150 (Operation 160).

Referring to FIG. 13, value adjustment methods without converting a color space according to some embodiments of the present inventive concept are described below. Saturation value is operated from the input image signal (R, G, and B) represented by the RGB color space (Operation 210). That is, the saturation value S is operated according to an operation formula to obtain the saturation value S of Equation 4 from the image signal (R, G, and B) represented by the RGB color space without converting a color space.

Next, a value adjustment rate to decrease the value based on the operated saturation value S is calculated (Operation 220). In detail, by using the gray scale adjustment line (2) of FIG. 4 or FIGS. 5A-5D, a value adjustment rate according to a saturation value may be calculated based on the value adjustment algorithm for determining the value adjustment rate so that a rate of decrease of the value may increase linearly or non-linearly as the saturation value decreases. Since the principle of calculating the value adjustment rate is described in the above, a description thereon will be omitted herein.

Next, R', G', and B' in which the value is adjusted are generated by adjusting each of the R, G, and B of the input image signal represented by the RGB color space according to the calculated value adjustment rate (Operation 230). That is, the value adjusted R', G', and B' are generated by multiplying each of the R, G, and B of the input image signal represented by the RGB color space by the value adjustment rate.

The display panel 400 is driven based on the R', G', and B' that are represented by the RGB color space in which the value is adjusted in operation 150 (Operation 240). According to the above operation, the power consumption of a display panel may be reduced by adjusting the value only according to a saturation value without converting saturation and hue.

The above-described value adjustment algorithm according to the present inventive concept may be applied to a color space such as YCbCr and/or YUV, among others. That is, in the YCbCr or YUV color space, value may be adjusted by adjusting a Y value with a gray scale.

Some embodiments of the invention can also be computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, etc. The computer readable recording medium can also be distributed over network coupled computer systems so that the computer readable code is stored and executed in a distributed fashion.

While the inventive concept has been particularly shown and described with reference to exemplary embodiments thereof, it will be understood that various changes in form and details may be made therein without departing from the spirit and scope of the following claims.

What is claimed is:

1. A method of operating an image display system, the method comprising:

calculating a calculated saturation value from an input image signal;

adjusting an input image signal value that corresponds to the input image signal according to the calculated saturation value by using a value adjustment algorithm for determining a value adjustment rate that decreases the input image signal value according to the calculated saturation value; and providing the adjusted input image signal value as an output from the circuit, wherein the value adjustment algorithm determines the value adjustment rate to allow a rate of decrease of the input image signal value to increase as the calculated saturation value decreases, wherein the image display system comprises at least one controller, and wherein the calculating, the adjusting, and the providing comprise operations performed by the at least one controller.

2. The method of claim 1, wherein the value adjustment algorithm determines the value adjustment rate to allow a rate of decrease of the input image signal value to linearly or non-linearly increase as the calculated saturation value decreases.

3. The method of claim 1, wherein the value adjustment algorithm determines the value adjustment rate to allow a rate of decrease of the input image signal value to linearly or non-linearly increase as the saturation value decreases without a decrease of the input image signal value on a condition that the calculated saturation value reaches a maximum.

4. The method of claim 1, wherein, in adjusting the input image signal value, the value adjustment rate corresponding to the calculated saturation value is obtained from a lookup table in which the value adjustment rate according to the calculated saturation value is set, and the input image signal value is adjusted by using an obtained value adjustment rate from the lookup table.

5. The method of claim 1, wherein, in adjusting the input image signal value, the value adjustment rate corresponding to the calculated saturation value is obtained from an operation formula based on the value adjustment algorithm for determining the value adjustment rate according to the calculated saturation value, and the input image signal value is adjusted by using an obtained value adjustment rate via the operation formula without conversion of the input image signal into a different color space.

6. The method of claim 1, wherein calculating the calculated saturation value comprises:

converting a RGB color space input image signal into a saturation and value related color space image signal that includes at least a saturation coordinate and a value-related coordinate; and determining a saturation coordinate value of an input image signal represented by a converted color space as a saturation value of the input image signal.

7. The method of claim 6, wherein the saturation and value related color space comprises a hue, saturation, and value (HSV) color space, a hue, saturation, and lightness (HSL) color space, or a hue, saturation, and intensity (HSI) color space.

8. The method of claim 1, wherein adjusting the input image signal value comprises:

calculating the value adjustment rate corresponding to the calculated saturation value by using the value adjustment algorithm; and decreasing a value of a value-related coordinate in the input image signal represented by a color space that includes a saturation coordinate and the value-related coordinate by using the calculated value adjustment rate.

9. The method of claim 1, wherein adjusting the input image signal value comprises:

calculating the value adjustment rate corresponding to the calculated saturation value by using the value adjustment algorithm; and decreasing an R coordinate value, a G coordinate value, and a B coordinate value with respect to the input image signal represented by an RGB color space by using the calculated value adjustment rate, wherein the R, G, and B coordinate values are decreased at a same rate.

10. The method of claim 1, further comprising driving a display panel based on adjusting the input image signal value.

11. An apparatus for processing a value adjustment signal, the apparatus comprising:

a saturation operation unit that is operable to obtain a saturation value from an image signal that is represented by an R coordinate value, a G coordinate value and a B coordinate value corresponding to an RGB color space;

an image signal value decrease rate calculation unit that is operable to calculate a value adjustment rate corresponding to an operated saturation value by using a value adjustment algorithm for determining the value adjustment rate according to the saturation value; and a value adjustment unit that is operable to adjust each of the R coordinate value, the G coordinate value, and the B coordinate value of the input image signal represented by the RGB color space by using the calculated value adjustment rat;

wherein the value adjustment algorithm determines the value adjustment rate to allow a rate of decrease of the R coordinate value, the G coordinate value, and the B coordinate value to linearly or non-linearly increase as the saturation value decreases.

12. The apparatus according to claim 11, wherein the value adjustment algorithm determines the value adjustment rate to allow the rate of decrease of the R coordinate value, the G coordinate value, and the B coordinate value to linearly or non-linearly increase as the saturation value decreases without conversion of the image signal represented by the RGB color space into a different color space.

13. The apparatus according to claim 11, further comprising:

a first color space converter that is operable to convert the image signal represented by the RGB color space into an image signal represented by a first color space including at least a saturation coordinate and a value-related coordinate.

14. The apparatus according to claim 13, further comprising a second color space converter that is operable to convert the image signal represented by the first color space in which the value-related coordinate value is adjusted into an adjusted image signal represented by the RGB color space.

15. The apparatus according to claim 13, wherein the first color space comprises a hue, saturation, and value (HSV) color space, a hue, saturation, and lightness (HSL) color space, or a hue, saturation, and intensity (HSI) color space.

16. The apparatus according to claim 11, wherein the value adjustment rate is obtained from a lookup table in which the value adjustment rate according to the calculated saturation value is set.

17. The apparatus according to claim 11, wherein the value adjustment rate is obtained from an operation formula based on the value adjustment algorithm.

18. An image display system comprising:

a value adjustment signal processing unit for generating a second image signal in which a value is adjusted based on a saturation value of a first image signal that is input by using a value adjustment algorithm for determining a value adjustment rate according to the saturation value, wherein the value adjustment algorithm determines the value adjustment rate to allow a rate of decrease of the value to increase as the saturation value decreases;

a source driving unit for generating a data line driving voltage corresponding to the second image signal;

a gate driving unit for generating a scan signal for selecting a gate line; and a display panel for displaying an image in response to the data line driving voltage and a scan signal.

19. The image display system of claim 18, wherein the value adjustment signal processing unit comprises:

a first color space converter for converting an image signal represented by an RGB color space into the first image signal represented by a first color space including at least a saturation coordinate and a value-related coordinate;

a value decrease rate calculation unit for calculating the value adjustment rate corresponding to a saturation coordinate value of the first image signal represented by the first color space by using the value adjustment algorithm;

a value adjustment unit for generating the second image signal represented by the first color space in which the value-related coordinate of the first image signal represented by the first color space is adjusted by using the calculated value adjustment rate; and a second color space converter for converting the second image signal represented by the first color space into an adjusted image signal represented by the RGB color space.

20. The method of claim 1, wherein the at least one controller comprises a value adjustment signal processing unit, wherein the calculating, the adjusting, and the providing comprise operations performed by the value adjustment signal processing unit.

* * * * *